US005277627A

United States Patent [19]

Matsuzaki

[11] Patent Number: 5,277,627

[45] Date of Patent: Jan. 11, 1994

[54] ELECTRICAL CONNECTOR FOR IC CARD

[75] Inventor: Shuichi Matsuzaki, Tokyo, Japan

[73] Assignee: Hirose Electric Co., Ltd., Tokyo, Japan

[21] Appl. No.: 36,850

[22] Filed: Mar. 25, 1993

[30] Foreign Application Priority Data

Jul. 27, 1992 [JP] Japan ..... 4-57881

[51] Int. Cl.[5] ..... H01R 13/64

[52] U.S. Cl. ..... 439/677; 439/76; 439/353

[58] Field of Search ..... 439/677, 680, 328, 350, 439/353, 59, 76, 607, 629, 630, 633, 636, 637

[56] References Cited

U.S. PATENT DOCUMENTS

| | | | |
|---|---|---|---|
| 4,780,603 | 10/1988 | Hamada | 439/677 |
| 4,925,397 | 5/1990 | Mirand et al. | 439/328 |
| 5,051,101 | 9/1991 | Komatsu | 439/350 |
| 5,158,473 | 10/1992 | Takahashi et al. | 439/353 |

FOREIGN PATENT DOCUMENTS 61-131081 6/1986 Japan .

*Primary Examiner*—Larry I. Schwartz
*Assistant Examiner*—Hien D. Vu
*Attorney, Agent, or Firm*—Kanesaka & Takeuchi

[57] ABSTRACT

A connector assembly consists of a first connector (20) having a thickness substantially equal to that of an IC card (10) and placed in a recess (11) of the IC card which incorporates an electrical circuit and a second connector (30) to be plugged into the first connector. The first connector includes a shield case (21); a first dielectric housing (23) placed in the shield case; a pair of first foolproof structures (23C, 23D) provided on opposite sides of the first dielectric housing. The first foolproof structures are made from a combination of divisions each defined by horizontal and vertical dividing lines and extending forwardly from a front face (23B) of the first dielectric housing. The second connector includes a second dielectric housing with a terminal support (32) extending forwardly therefrom; a pair of second foolproof structures (32A, 32B) provided on opposite sides of the terminal support. The second foolproof structures are made in such configurations that they fit into the first foolproof structures, thereby preventing plugging a wrong connector.

1 Claim, 4 Drawing Sheets

ELECTRICAL CONNECTOR FOR IC CARD

BACKGROUND OF THE INVENTION

1. Field of the Invention

The present invention relates to electrical connectors for IC cards.

2. Description of the Related Art

Japanese U.M. patent application Kokai No. 61-131081 discloses a thin-type electrical connector having a foolproof structure that allows the connector to fit into only a specific connector. It is desirable that the connector is able to fit into as many different connectors as possible. Consequently, the foolproof structure should be flexible. The foolproof structure has a number of key grooves extending laterally on the upper and lower fitting edges. A planar key is inserted into a given position and number of key grooves that prevent plugging wrong connectors. This foolproof structure is convenient because by selecting the key position and number it is possible to provide a variety of foolproof structures without difficulty.

However, since the key groove and the key are provided on the upper and lower fitting edges, the thickness of the connector increases by that much. Consequently, it is hardly possible to provide a connector useful for IC cards which have a thickness of about 3 mm because the thickness of the key is one to two millimeters.

SUMMARY OF THE INVENTION

Accordingly, it is an object of the invention to provide a thin-type electrical connector which is sufficiently thin to be used for IC cards and able to provide a variety of foolproof structures.

According to the invention there is provided a connector assembly consists of a first connector having a thickness substantially equal to that of an IC card and placed in a recess of the IC card which incorporates an electrical circuit and a second connector to be plugged into the first connector. The first connector includes a shield case; a first dielectric housing placed in the shield case; a pair of first foolproof structures provided on opposite sides of the first dielectric housing. The first foolproof structures are made from a combination of divisions each defined by horizontal and vertical dividing lines and extending forwardly from a front face of the first dielectric housing. The second connector includes a second dielectric housing with a terminal support extending forwardly therefrom; a pair of second foolproof structures provided on opposite sides of the terminal support. The second foolproof structures are made in such configurations that they fit into the first foolproof structures, thereby preventing plugging a wrong connector.

Such foolproof structures allows only specific electrical connectors to plug into each other. Since the foolproof structures are provided on opposite sides of the contact terminal array so that it is possible to make the thickness of the connectors no more than that of the IC card.

Since the foolproof structures consists of divisions combined, it is easy to make a variety of foolproof structures simply by changing the combination of pins in the metal mold.

The above and other objects, features, and advantages of the invention will be more apparent from the following description when taken in conjunction with the accompanying drawings.

DESCRIPTION OF THE PREFERRED EMBODIMENT

Figure 1:
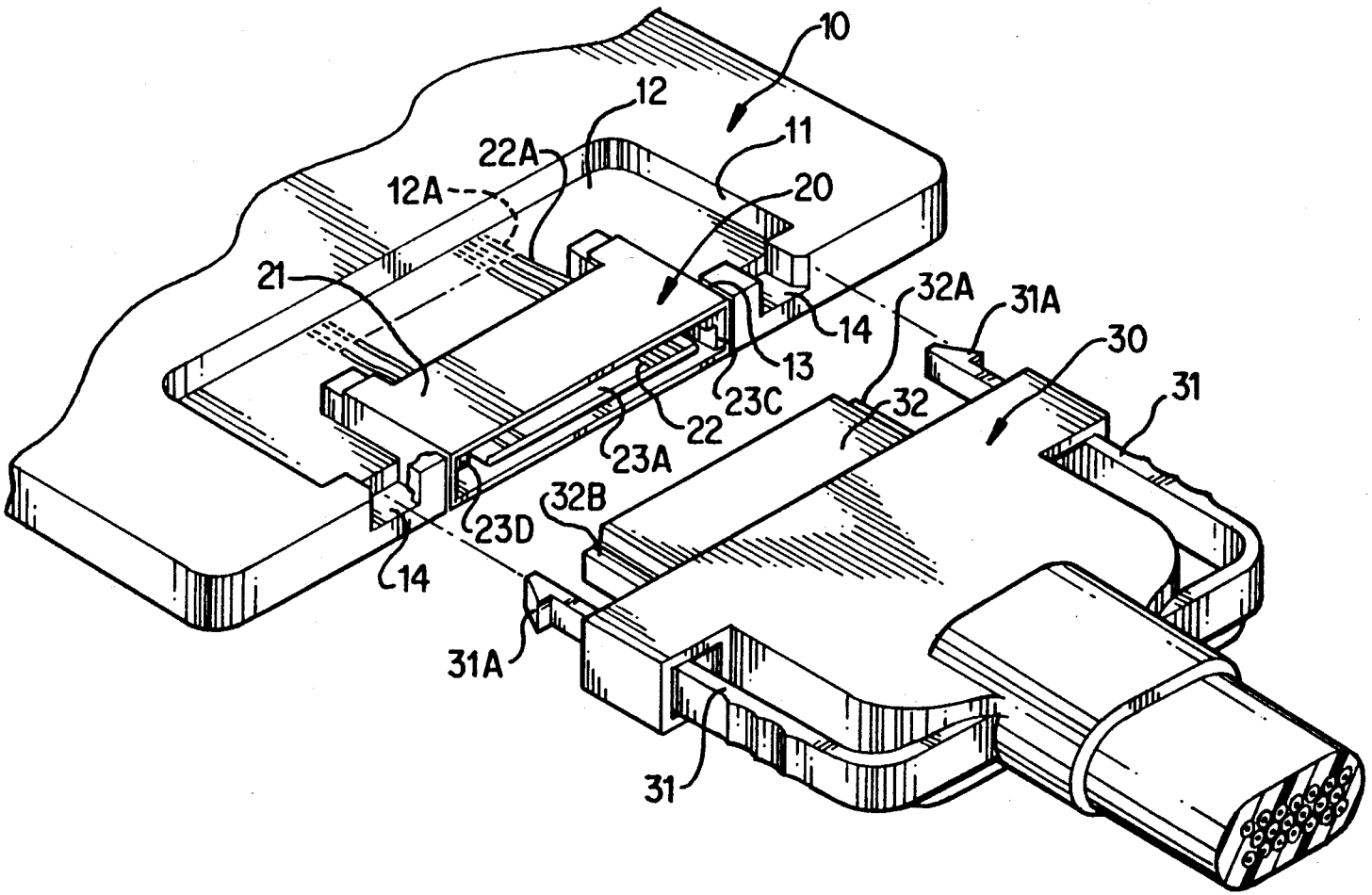
FIG. 1 is a perspective view of an electrical connectors used for an IC card according to an embodiment of the invention.

In FIG. 1, an IC card 10 has a recess 11 which has a front opening 13 on a plugging side. The connection section 12 of a circuit board is exposed through the recess 11. The width of the opening 13 is made substantially equal to that of a first connector 20. A pair of lock openings 14 are formed on opposite sides of the front opening 13.

Figure 2:
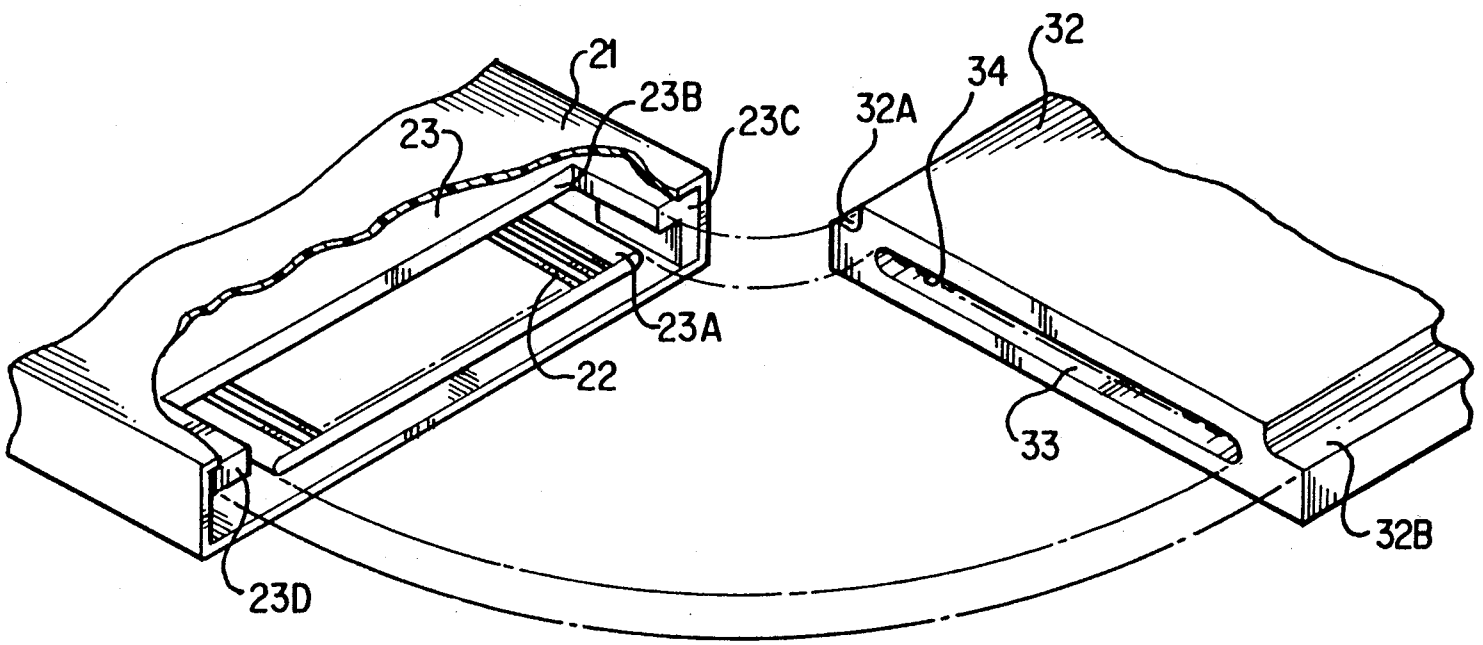
FIG. 2 is a partially cutaway perspective view of the electrical connectors.

In FIG. 2, the first connector 20 includes a shield case 21 which is made from sheet metal, and a dielectric housing 23 which is placed in the shield case 21 and has a support plate 23A on which contact terminals 22 are arranged. The thickness of the first connector 20 at the front edge where the support plate 23A lies is substantially equal to that of the IC card 10. As shown in FIG. 1, the thickness of rear portion of the first connector 20 is decreased stepwise and placed on the connection section 12 of the circuit board. The total thickness of the rear portion and the connection section 12 is substantially equal to that of the IC card 10. As shown in FIG. 2, the support plate 23A extends forwardly from the front face 23B of the housing 23 to support the contact terminals 22 on the upper surface. As shown in FIG. 1, the contact terminals 22 project rearwardly from the rear end of the housing 23 to form the connection portions 22A, which are connected to the corresponding conductors 12A of the connection section 12.

Figure 3:
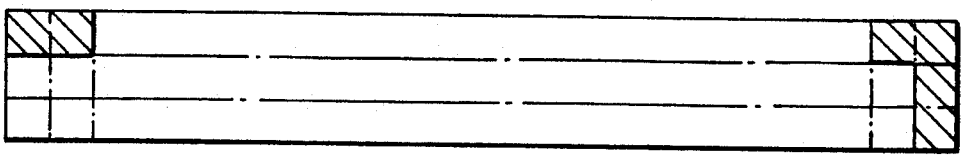
FIG. 3 is a front elevational view of foolproof structures of a first electrical connector according to an embodiment of the invention.
Figure 4:
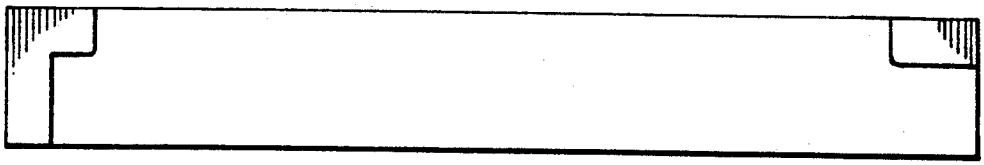
FIG. 4 is a front elevational view of foolproof structures according to another embodiment of the invention.
Figure 5:
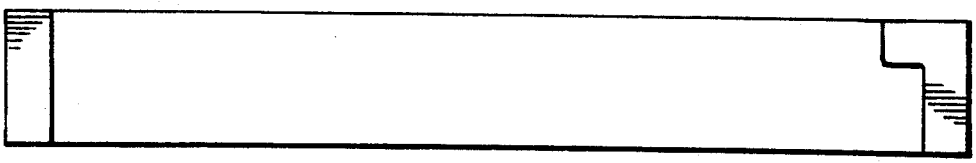
FIG. 5 is a front elevational view of foolproof structures according to still another embodiment of the invention.
Figure 6:
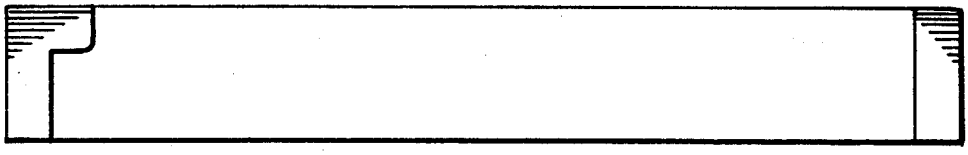
FIG. 6 is a front elevational view of foolproof structures according to yet another embodiment of the invention.
Figure 7:
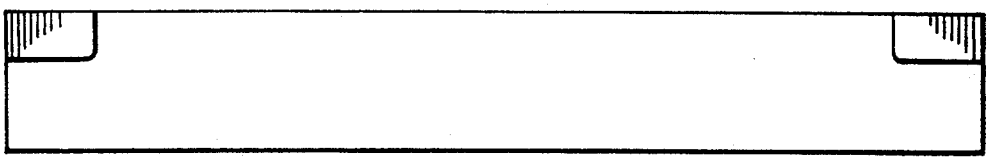
FIG. 7 is a front elevational view of foolproof structures according to another embodiment of the invention.

A pair of foolproof structures 23C and 23D each comprising a key extends forwardly from opposite sides of the front face 23B. As shown by hatching in FIG. 3, the foolproof structures 23C and 23D are made from a certain number of combined divisions, each of which is defined by dividing horizontal and vertical lines. These foolproof structures are formed integrally with the housing 23. In this embodiment, the foolproof structure 23C from four divisions forming an inverted L-shape cross-section while the foolproof structure 23D is made from two divisions forming a horizontally elongated rectangular cross-section.

Alternatively, by selecting the number and position of divisions combined it is possible to make the foolproof structures in a variety of forms as shown in FIGS. 4 through 7.

Referring back to FIG. 1, a second connector 30 has a pair of lock arms 31 on opposite sides of a dielectric housing. The lock arms 31 extend forwardly from the rear portion of the housing in the form of a cantilever so that they can flex. The front end of each lock arm 31 is formed as a hook 31A. When the connector is plugged in, the lock arms 31 flex inwardly as they enter the front openings 14. When the hooks 31A pass through the front openings 14, the lock arms 31 return to the original positions to engage the IC card.

A terminal support 32 extends forwardly from the front face of the housing 30 to support contact terminals. As shown in FIG. 2, the terminal support 32 has a receiving opening 33 for receiving the plate support 23A of the first connector. The contact terminals 34 are arranged within the receiving opening 33. A pair of second foolproof structures 32A and 32B comprising channels are made on opposite sides of the terminal support 32 in such configurations that they receive the first foolproof structures 23C and 23D. The second foolproof structures may of course be modified according to the variants of the first foolproof structures as shown in FIGS. 4–7.

Since the foolproof structures 23D, 23D, 32A, and 32B are formed on opposite sides of the housing, it is possible to make the thickness of the connectors no more than that of the IC card. Although the width of the connectors is increased, there is sufficient room in the IC card to accommodate the increase.

In addition, it is possible to make a variety of foolproof structures integrally with the housing by selecting combinations of pins in the metal mold thereby changing the combinations of divisions. Thus, it is possible to make a number of foolproof structures by means of a single metal mold.

According to the invention, it is possible to make a thin-type electrical connector which has a thickness no more than that of the IC card itself, thus facilitating the design of the connector. In addition, it is possible to enhance the connector performance by providing an additional array of contact terminals on the support plate. Since only a single metal mold is needed, the unit manufacturing cost is reduced.

I claim:

1. A connector assembly comprising:

a first connector having a thickness substantially equal to that of an IC card and placed in a recess of said IC card which incorporates an electrical circuit;

a second connector to be plugged into said first connector;

said first connector comprising:

an electrical conductive shield case;

a first dielectric housing placed in said shield case;

a pair of first foolproof structures provided on opposite sides of said first dielectric housing;

said first foolproof structures each comprising a key extending forwardly from a front face of said first dielectric housing;

said second connector comprising:

a second dielectric housing;

a pair of second foolproof structures provided on opposite sides of said second dielectric housing;

said second foolproof structures comprising channels being made in such configurations that they receive said first foolproof structures, thereby preventing mating with wrong connector.

* * * * *